United States Patent [19]

Loewen et al.

[11] Patent Number: 4,712,299

[45] Date of Patent: Dec. 15, 1987

[54] PROCESS FOR PRODUCING ELECTRICAL CONTACTS FOR FACILITATING MASS MOUNTING TO A CONTACT HOLDER

[75] Inventors: Heinz Loewen, Gardena; Wold Wenko, Pasadena, both of Calif.

[73] Assignee: Electronic Plating Service, Inc., Gardena, Calif.

[21] Appl. No.: 831,691

[22] Filed: Feb. 21, 1986

[51] Int. Cl.[4] ..... H01R 43/04

[52] U.S. Cl. ..... 29/882; 439/816; 439/885; 439/874

[58] Field of Search ..... 29/874, 882; 339/256 R, 339/258 R

[56] References Cited

U.S. PATENT DOCUMENTS

| | | | |
|---|---|---|---|
| 2,689,337 | 9/1954 | Burtt et al. | 339/275 T X |
| 2,711,524 | 6/1955 | Beaver | 339/275 T X |
| 3,348,192 | 10/1967 | De Vito | 339/275 T X |
| 3,420,087 | 1/1969 | Hatfield et al. | 29/874 X |
| 3,538,491 | 11/1970 | Longenecker et al. | 339/256 R |
| 3,543,227 | 11/1970 | Moulin | 339/256 R |
| 3,663,931 | 5/1972 | Brown | 339/256 R X |
| 3,665,378 | 5/1972 | Hammell et al. | 339/256 R X |
| 3,853,389 | 12/1974 | Occhipinti | 339/258 R X |
| 4,448,477 | 5/1984 | Gladd et al. | 339/256 R X |
| 4,480,386 | 11/1984 | Adams | 29/874 |
| 4,540,233 | 9/1985 | Saito et al. | 339/258 R |

FOREIGN PATENT DOCUMENTS 1571602 7/1980 United Kingdom ..... 29/874

*Primary Examiner*—Howard N. Goldberg
*Assistant Examiner*—Carl J. Arbes
*Attorney, Agent, or Firm*—Sughrue, Mion, Zinn, Macpeak & Seas

[57] ABSTRACT

A plurality of contacts are stamped out of flat sheet metal stock simultaneously with blank forming female rectangular contact boxes initially flat, with a male contact extending therefrom, and with each box material blank joined to a common carrier strip extending longitudinally of the contact array. The flat box material blanks are initially equal to or slightly less than a fraction of the distance D between uniformly spaced holes within the holder. While maintaining the contacts linked to the carrier strip, the lateral side edges of the box material blanks are bent up and swaged to thin the box material portions and laterally expand those portions, widthwise, in excess of D. Subsequently, the box material portions are coined with opposite sides bent into complete rectangular box form of standard size, with the ends of the box facing and abutting, allowing a complete series of formed, standard box contacts, via the male contact parts, and while linked to the carrier strip, to be simultaneously mounted to respective ones of said holder holes.

4 Claims, 8 Drawing Figures

PROCESS FOR PRODUCING ELECTRICAL CONTACTS FOR FACILITATING MASS MOUNTING TO A CONTACT HOLDER

FIELD OF THE INVENTION

This invention relates to the manufacture of electrical connectors and, more particularly, to a process for stamping elongated electrical contacts from flat metal stock linked to a carrier strip and utilizing process steps facilitating mass mounting of the contacts, while linked to the carrier strip, to plastic holders having uniformly spaced holes for receiving male contact parts which are inserted within said holes.

BACKGROUND OF THE INVENTION

A standard connector or contact block in the electronics industry consists of a plastic holder having a plurality of small diameter, aligned, equally spaced holes within a face of the holder within which project male contact parts of a series of identical female contacts, whose female parts take the form of a rectangular box, in cross-section. Thus, each sheet metal contact or connector has a female part which is box shaped and a male part integral therewith and extending outwardly of the box and projecting through the opposite side of the plastic holder by penetrating completely a hole within the plastic holder. Plastic holders having holes spaced by 0.100 inches for receiving the male contact parts are standard in the industry. Additionally, the size of the contacts which fit into the holes is standard and thus the dimensions of the female contact box are also standard in the industry.

Typically, such contacts are stamped out as a plurality of identical units simultaneously from sheet metal stock. When stamped out, the box material portions or blanks of the contacts are initially flat with a male contact part integral with the box material portions and extending axially from the center thereof to facilitate the multiple steps in the completion of the connectors or contacts. A carrier strip portion of the sheet metal stock remains connected to all of the "flattened" box material portions of the contacts via small thin leads aligned with the male contact parts.

In the past, the contacts after flat sheet stamping were folded to form the female contact boxes, and after separation from the carrier strip, individually, the male parts were placed in one of the holes in the plastic holder.

Due to the necessary "standard" size of the boxes for the contacts, the width of the "flattened" box is of a given dimension, i.e., dimension D, for instance, of 0.207 inches. The center-to-center spacing of the contacts at the time they are initially stamped out and commonly connected to the carrier strip is 0.230 inches. This dimension is mandated by the width of the "flattened" box material. It is neither equal to nor a multiple of the "spacing" between the holes within the plastic holders. Thus, the typical stamping process parameters frustrate attempts to effect simultaneous insertion of the male contact parts within respective aligned holes within the plastic holders ultimately receiving the same prior to separation from the common carrier strip support.

The female electrical contacts conventionally known as dual beam female electrical contacts mate with contacts on circuit boards and receive male pin connectors. Typically, the female electrical contacts include a female contact portion of rectangular box cross-section including laterally opposed finger projections or beams which have bent, oblique portions creating an entranceway for the male contact pins to effect the electrical connection between a male contact pin and the female box contact. The lateral beams are integrated to the female contact center line or spine. In the known processes for stamping dual beam contacts, it is important to minimize wastage of the flat metal strip stock subject to the stamping process since such waste materially increases the cost of manufacture of the dual beam contacts.

U.S. Pat. No. 4,480,386, issued to John E. Adams on Nov. 6, 1984 and entitled Process for Producing Dual Beam Electrical Contact, shows a typical sequence of stamping out and forming a plurality of dual beam female box-type contacts with the contacts each being joined to a carrier strip by means of small leads as an extension of the spine. As may be seen from the patent, the flat metal strip stock is first punched to form a series of circular, longitudinally spaced pilot holes which holes are used to guide the strip stock for further stamping. The flat metal stock material is moved sequentially in the direction of the path defined by the pilot holes and subjected to a series of reciprocating punches. Typically, a first punch prescribes the outlines of the beams, the center line or spine, and any tabs. The punches at succeeding stations may function to separate adjacent contacts by effecting a slitting action separating the contacts by a thin transverse line and completely separate the beams with the exception of a juncture at one end to the female contact box material portion. The punch operations may be simplified by using a single punch for effecting the complete outline and a second punch to effect the slitting operation separating the contacts laterally. Further, portions of the sheet stock as, for instance, the end of the beams, may be swaged during a given one of the punch steps.

Once the components are "stamped out", it is conventional to plate all or some of the contact surface area with a highly electrical conductive metal coating prior to folding the flattened box portion and additional portions thereof to complete the essentially closed, rectangular, female contact box. Such actions constitute either a single forming step or a sequence of forming steps during which the beams are bent upwardly at right angles to the center line or spine, and the outer edges of the flattened box sheet stock material are in turn bent at right angles to the beams into coplanar, edge end facing position. In view of the standard dimensional requirements for the female contact box, the lateral width of the flattened box is invariable in terms of the final product.

It is, therefore, a primary object of the present invention to produce a female, dual beam box contact of standard box dimensions with minimal center-to-center spacing permitting group mounting of a plurality of such contacts while linked to the carrier strip for insertion within respective holes of a plastic holder and wherein the center-to-center spacing of the contacts is equal to or a multiple of the center-to-center spacing of the holes within the plastic holder receiving the same, without compromising the necessity of the width of box material of the contacts, when flattened, to be in excess of the center-to-center spacing of the contacts on the carrier strip.

SUMMARY OF THE INVENTION

The invention relates to a process of making a series of standard sized contacts from flat strip metal stock while commonly joined thereto and involving the steps of advancing a said flat strip metal stock, removing material from the strip to form a carrier strip and a plurality of linked space blanks including integrally, a spine, side portions to opposite sides thereof terminating in lateral edge portions, bending sequentially portions of the blank to cause the side portions to extend perpendicular to the spine and the lateral edge portions to extend perpendicular to said side portions to form a rectangular, female contact box with the ends of the edge portions facing each other and in near abutment. The improvement resides in stamping the blanks on centers such that the lateral widths of the blanks forming the box contacts are less than the width of the strip material necessary to complete a standard size box, when bent into closed box form, and in thinning at least portions of each blank forming said box subsequent to forming the blanks to increase the effective overall width of the box material to that capable of completing a standard size contact box whereby a series of box contacts while still linked to the carrier strips may be commonly, simultaneously mounted to a a support having spaced contact receiving and mounting means on centers equal to, a multiple of or fraction of the centers for the blanks, thereby permitting initial severing of the blanks narrower than their required width to achieve said standard size as a result of bending to minimize waste of strip stock during contact fabrication.

The blanks may include an integral male contact portion extending longitudinally outwardly of the spine to the opposite side of the blank coupled to the carrier strip and the support may have a series of equally spaced, aligned holes sized to the male contact portion for insertedly receiving the male contact portion of the contacts while linked to the carrier strip. Further, the thinning of at least a portion of the blank, may involve the swaging the lateral edge portions of the blanks to increase their lateral width and thus the overall width of the blank forming the box contact. Further swaging and bending may be effected simultaneously.

DETAILED DESCRIPTION OF THE PREFERRED EMBODIMENT

Figure 1:
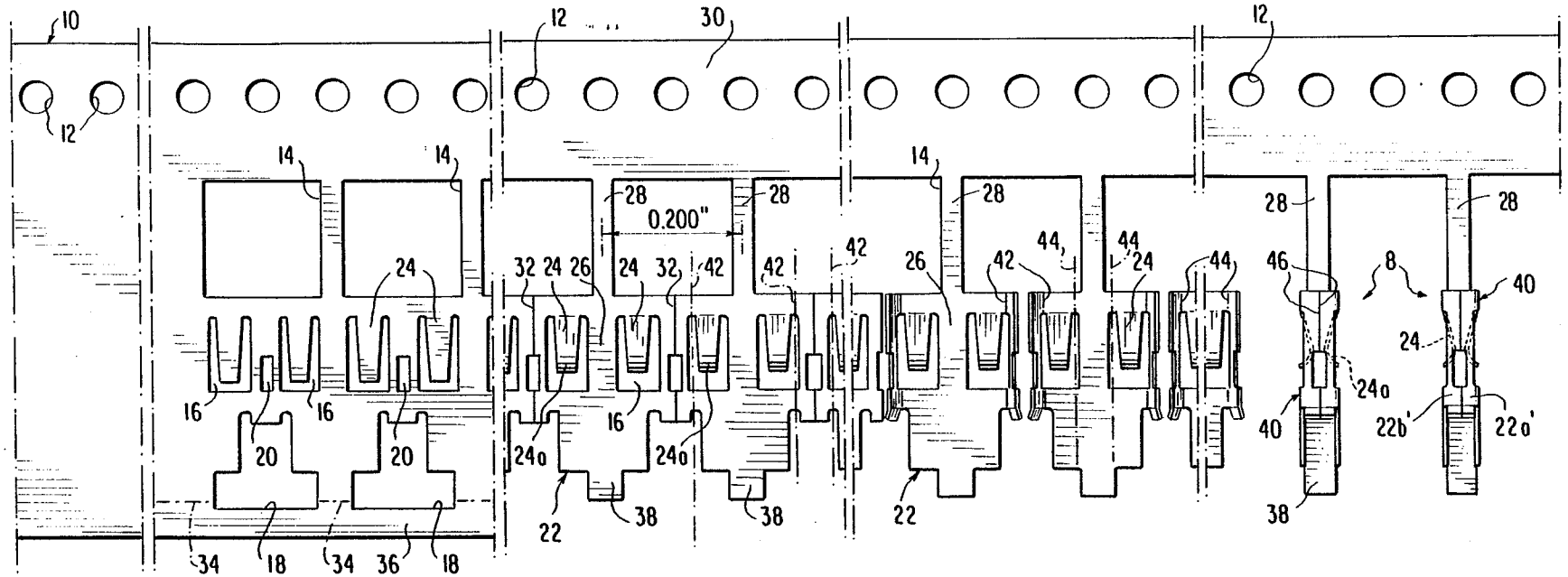
FIG. 1 is a plan view of a flat strip of thin stock metal illustrating the sequence of punching and forming steps employed in the manufacture of the improved female box-type electrical contact illustrating a preferred method of the present invention in the creation of such contact.

A series of identically sized and configured dual beam female electrical box contacts 8 are formed using flat metal strip stock 10, the metal stock being formed of a suitable, highly conductive metal such as copper, bronze, cupro-nickel, phosphor-bronze and the like. The stock may be of a thickness of about 0.010 inches.

The flat metal strip stock 10 may be first punched to initially form a line of pilot holes 12, the pilot holes being of an appropriate diameter and, importantly, being spaced 0.1 inches apart, i.e., on one-tenth inch centers. Holes 12 function to guide the strip stock 10 along a path longitudinally to the right or left, FIG. 1, and in sequence through multiple stamping and forming operations. Only a portion of the sequence, however, is material to the present invention, and a considerable portion of the multi-step forming process is quite similar to that of referred to U.S. Pat. No. 4,480,386.

In that regard, it may be assumed that one or more punching steps, at given punching stations, effect blanking or stamping of the metal sheet stock 10 to create pilot holes 12 and to further cut out from the metal strip stock, whose width may be one inch, the creation of longitudinally spaced, rectangular cut outs or holes 14, a series of U-shaped holes 16, a series of inverted T-shaped holes 18, and a series of small, elongated, rectangular holes 20 as shown. Holes 14 and 18 tend to form a box material portion or blank, indicated generally at 22, within the metal strip stock 10. In the initial punching or blanking step or steps, there is, therefore, created: a carrier strip 30; the outline of paired beams 24; a center line or spine 26 and leads 28 connecting the box material portion 22 to carrier strip 30 bearing the pilot holes 12 and functioning to facilitate step-by-step movement of the metal strip stock 10 along one or more punching or blanking stations, a slitting station and multiple forming stations, and male contact parts 38.

In the sequence, slitting traverse to the longitudinal axis of strip 10 is effective to sever the box material portion 22 into box material portions or blanks via slit lines 32. Further longitudinal slitting occurs along longitudinal slit lines 34, severing the spine 26 (remote from the carrier strip 30) from the balance of metal strip stock 10 and permitting the discard of a further strip 36 to the side opposite that of carrier strip 30. This insures that male contact part 38 will project outwardly of a completed female box contact 8.

Important to the present invention is the realization that the box material portions defined by transverse slit lines 32 are initially of a lateral width slightly less than the 0.2 inch center lines 42 as indicated in FIG. 1 corresponding to the distance between alternating pilot holes 12. After slit lines 32 are formed, at a slitting station and subsequent to a complete blanking of the metal strip stock 10, the width of the flattened box material portion for each contact 8 is slightly less than 0.200 inches. The present invention is directed to a modification of the forming step to effect a lateral width increase or elongation of at least a part of the box material portion or blank 22 of each contact 8 to ensure that the box contact 8 is of "standard" size. This is achieved in the manner of the sequence shown in FIGS. 2, 3 and 4.

Figure 3:
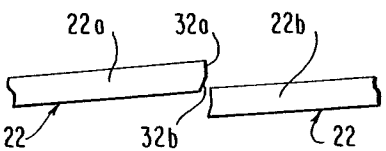
FIG. 3 is an elevational view of a portion of the strip as seen in FIG. 2 during initial forming.
Figure 2:
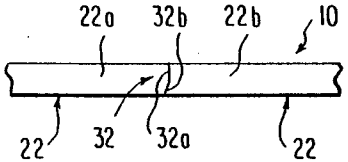
FIG. 2 is an elevational view of a portion of the strip as a result of the slitting at the slitting station.
Figure 5:
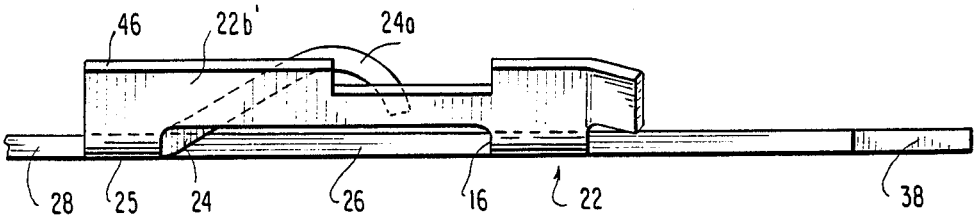
FIG. 5 is a side elevational view of the box material portion of one of the contacts of the strip of FIG. 1, after slitting and forming, but prior to bending of the beams at right angles to the spine and parallel to each other to create the basic box portion of the female contact.

FIG. 2 shows a section of the metal strip stock 10 at one of the transverse slit lines 32. The slits 32 are formed without any strip deformation and with both portions *22a*, *22b* of the side-by-side flattened box coplanar. In FIG. 3, right side box portion section *22a* of a given contact blank 22 is displaced relative to left side section *22b* of an adjoining blank 22. Further, it is noted that each slit 32 is comprised of a vertical slit portion *32a* at the top and an oblique portion *32b* at the bottom. This facilitates upward bending given to section *22a* and separately thereof, away from section *22b*, which is freely permitted, at a downstream punch station.

Figure 4:
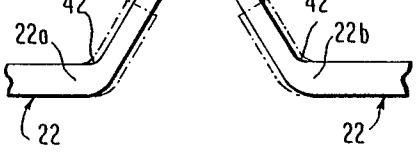
FIG. 4 is a further elevational view of the strip portion shown in FIGS. 2 and 3, in sequence, showing light coining of the slit strip portion and swaging of an outside edge of the box material portion of the female contact to laterally elongate the box material to ensure completion of the box of "standard" size.
Figure 6:
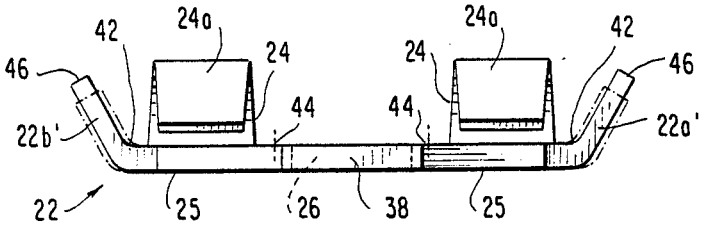
FIG. 6 is an end view of the contact box material portion shown in FIG. 5.
Figure 7:
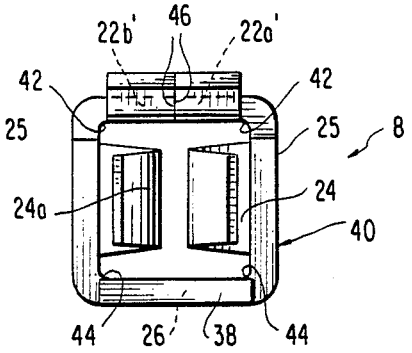
FIG. 7 is an end view of the contact after bending the portions bearing the beams at right angles to the spine into right angle parallel positions and further bending of the box side edges at right angles to the beams and into near edge end abutting position.
Figure 8:
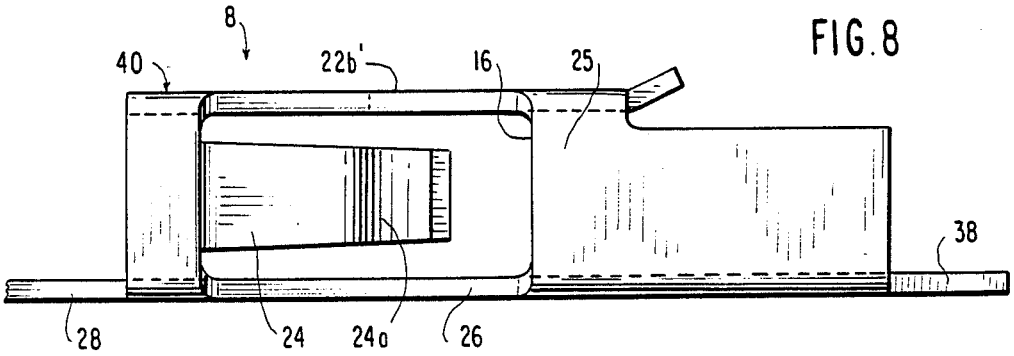
FIG. 8 is a side elevational view of the completed box contact of FIG. 8.

FIG. 4 shows further forming or deformation of sections *22a*, *22b* which may be achieved at the same station as that where initial separation occurs in accordance with FIG. 3. At this punch station, the section *22a* of the box material portion 22 and, specifically, its outer edge *22a'* is deflected upwardly by light coining of section *22a* along a line 42 while simultaneously at least the edge portion *22a'* is swaged to reduce the thickness of that portion and at the same time extend its lateral width as indicated in dotted lines, thereby increasing the total lateral width of box material portion or blank 22. Simultaneously with this occurring to one edge of the box material portion *22a* of a blank, the opposite edge *22b'* is identically coined along a similar line 42 and thinned, but elongated in width, in the manner of the dotted lines to create the equivalent of a "flattened" box width of 0.207 inches to thereafter effect a completed box of standard size. The added widths of dual edges *22a'*, *22b'*, right angle integral sides 25, and spine 26 from which the sides 25 project, totals 0.207 inches. In progressing from FIG. 6 to FIG. 8, box 40 of contact 8 is formed such that initially box 40 has a box material portion or blank 22 bent upwardly along both sides of spine 26 along forming lines 44, to define sides 25, causing it to take nearly the shape shown in FIG. 7, whereupon edges *22a'*, *22b'* are bent oppositely towards each other at full right angles to the sides 25 into end 46 facing, near end abutting position as shown in FIG. 7, about coin lines 42 for each of the edges.

During the initial contact forming, i.e., stamping provides, a curl at *24a* is provided to each of the beams 24.

What is claimed is:

1. In a process of making a series of standard size contacts from flat strip metal stock while commonly joined thereto, comprising steps of:

advancing said flat strip metal stock;

removing material from said strip metal stock to form a carrier strip and integrally, a plurality of laterally separated blanks, and bending sequentially portions of said blank to cause said blank to form a female contact portion of generally tubular form;

the improvement comprising:

stamping said blanks on centers such that the lateral width of each blank forming said tubular contact portion is less than the width of the strip metal stock material necessary to complete a standard size tubular contact portion; and thinning at least a portion of each blank, subsequent to forming said blanks to increase the effective overall width of the blank tubular contact material to permit completion of a tubular contact portion of standard size whereby the tubular contact portions can be commonly mounted simultaneously to a support having respective uniformly spaced contact receiving and mounting means on centers equal to, a multiple of, or a fraction of said centers for said blanks thereby permitting initial severing of said strip to form each blank narrower than that the required width to achieve a tubular contact portion of standard size, while minimizing waste of strip metal stock material during contact fabrication.

2. The process as claimed in claim 1 wherein said blanks include integrally, a spine and side portions to opposite sides of the spine terminating in lateral edge portions, and said coining consists in bending sequentially portions of said blank to cause said side portions to extend perpendicular to said spine and to opposite sides thereof, and said lateral edge portions to extend perpendicular to said side portions to form a rectangular female contact box with the ends of said blank edge portions facing each other and substantially in abutment, and wherein, said step of coining at least a portion of each blank consists in sequentially coining portions of said blank at four locations during formation of the rectangular female contact box.

3. The process as claimed in claim 2 wherein, said step of coining at least one portion of each blank comprises swaging the lateral edge portions of said blank side portions.

4. In a process of making a series of standard size contacts from flat strip metal stock while commonly joined thereto, comprising steps of:

advancing said flat strip metal stock;

removing material from said strip metal stock to form a carrier strip and integrally, a plurality of laterally separated blanks, and bending sequentially portions of said blank to cause said blank to form a female contact portion of generally complete tubular form;

the improvement comprising:

stamping said blanks on centers such that the lateral width of each blank forming said tubular contact portion is less than the width of the strip metal stock material necessary to complete a standard size tubular contact portion; and coining at least a portion of each blank, subsequent to forming said blanks to thin said portion and to increase the effective overall width of the blank tubular contact material while bending said portion to facilitate completion of a tubular contact portion of standard size whereby the tubular contact portions can be commonly mounted simultaneously to a support having respective uniformly spaced contact receiving and mounting means on centers equal to, a multiple of, or a fraction of said centers for said blanks thereby permitting initial severing of said strip to form each blank narrower than the required width to achieve a complete tubular contact portion of standard size, while minimizing waste of strip metal stock material during contact fabrication.

* * * * *